US005962798A

United States Patent [19]

Meinl

[11] Patent Number: 5,962,798

[45] Date of Patent: Oct. 5, 1999

[54] PERCUSSION INSTRUMENT

[75] Inventor: Reinhold Meinl, Neustadt/Aisch, Germany

[73] Assignee: Roland Meinl Musikinstrumente GmbH & Co., Neudstadt/Aisch, Germany

[21] Appl. No.: 09/265,376

[22] Filed: Mar. 10, 1999

[30] Foreign Application Priority Data

Mar. 26, 1998 [EP] European Pat. Off. ..... 98105491

[51] Int. Cl.[6] ..... G10D 13/02

[52] U.S. Cl. ..... 84/418; 84/419; 84/411 R; 84/414

[58] Field of Search ..... 84/418, 419, 411 R, 84/414; 38/102.2, 102.91; 101/407.1; 160/380, 395

[56] References Cited

U.S. PATENT DOCUMENTS

| | | | |
|---|---|---|---|
| 3,636,801 | 1/1972 | Moore | 84/411 |
| 4,334,458 | 6/1982 | Grauso | 84/411 R |
| 4,356,756 | 11/1982 | Hartary | 84/418 |
| 5,385,076 | 1/1995 | Belli | 84/414 |
| 5,555,653 | 9/1996 | Morgan | 38/102.2 |
| 5,581,044 | 12/1996 | Belli et al. . | |

FOREIGN PATENT DOCUMENTS

| | | |
|---|---|---|
| 0 153 595 | 9/1985 | European Pat. Off. . |
| 296 13 409 U | 10/1996 | Germany . |
| 669 474 | 3/1989 | Switzerland . |

*Primary Examiner*—William M. Shoop, Jr.
*Assistant Examiner*—Kim Lockett
*Attorney, Agent, or Firm*—Browdy and Neimark

[57] ABSTRACT

In a percussion instrument, for example in the form of a tambourine, of bongos, congas or the like, with a resonance body open in particular on top, a skin being stretched over the upper opening and comprising a plastic film which is fixed at a constant tension by means of a clamping hoop, the skin being stretched directly over the resonance body, and the resonance body having an annular groove in the vicinity of the upper opening, and the clamping hoop being elastically widened and forced over the upper side of the resonance body into the annular groove, thus stretching the skin, it is provided that at least one nonwoven fabric is disposed in parallel to the at least one plastic film, the nonwoven also being stretched by the clamping hoop and not being joined to the plastic film by gluing.

4 Claims, 1 Drawing Sheet

PERCUSSION INSTRUMENT

BACKGROUND OF THE INVENTION

1. Field of the Invention

The invention relates to a percussion instrument for instance in the form of a tambourine, of bongos, congas or the like, with a resonance body open in particular on top, a skin being stretched over the upper opening and comprising a plastic film which is fixed at a constant tension by means of a clamping hoop, the skin being stretched directly over the resonance body, and the resonance body having an annular groove in the vicinity of the upper opening, and the clamping hoop being elastically widened and forced over the upper side of the resonance body into the annular groove, thus stretching the skin.

2. Background Art

A percussion instrument of the generic type is known from DE 296 13 409 U. Percussion instruments of this type have been extraordinarily successful in practice, in particular for the production at a low cost of percussion instruments for musical school and preparatory school education and formation.

It has also been known to use laminates of a nonwoven with a plastic film as a skin, the strength of the skin thus being increased. In this case, the term "laminate" is to be understood as the nonwoven and the plastic film being united by full-surface gluing.

It is also known to utilize two layers of plastic films as a skin for the effective thickness of the skin to be increased in this way.

SUMMARY OF THE INVENTION

It is the object of the invention, to render a percussion instrument of the type under regard fabricable at a low cost on the one hand and on the other hand to obtain a very specific new sound effect.

According to the invention, this object is attained by a nonwoven being disposed in parallel to the plastic film, the nonwoven also being stretched by the clamping hoop and not being joined to the plastic film by gluing.

The gist of the invention resides in combining a clamping system known per se with a skin which consists of a non-glued combination of plastic film and nonwoven fabric. This helps to save the conventionally necessary prefabrication of a laminate, and moreover to obtain an especially agreeable, characteristic and soft sound, it being possible to realize certain timbres by an arbitrary combination of certain nonwoven fabrics and films, in particular of nonwoven and film thicknesses.

Remarkably, such a combined skin in connection with the clamping system provided possesses a very high continuous elastic force, i.e. only very low permanent deformation and yielding of the skin is observed during continuous strain by high forces perpendicular to the surface of the skin.

In keeping with another embodiment it can be provided that the nonwoven is a flash-melt-spun material, in particular a polyethylene fiber material.

A polyester film is preferably utilized as a plastic film.

Details of the invention will become apparent from the ensuing description of a preferred embodiment, taken in conjunction with the drawing.

DESCRIPTION OF THE PREFERRED EMBODIMENT

Figure 1:
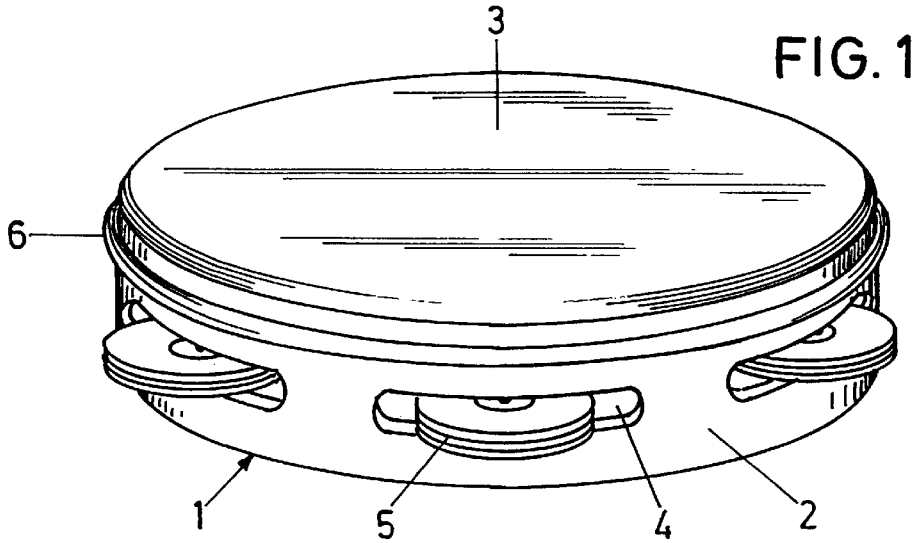
FIG. 1 is a perspective view of a percussion instrument according to the invention in the form of a tambourine.
Figure 2:
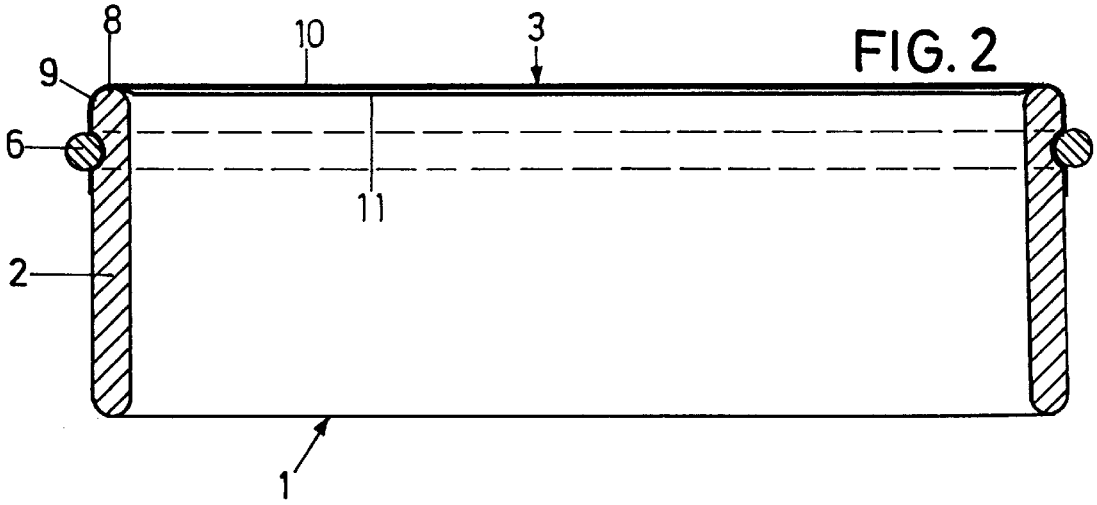
FIG. 2 is a sectional view of the percussion instrument according to FIG. 1.
Figure 3:
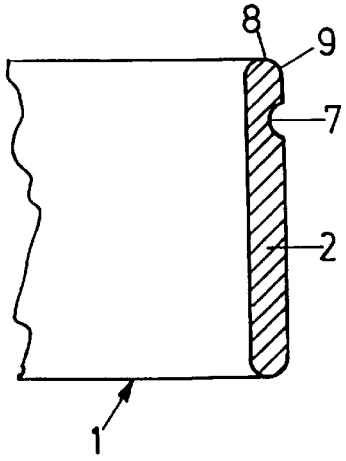
FIG. 3 is a sectional view of one side of the side wall.

A percussion instrument 1 seen in the drawing comprises a resonance body 2 of substantially cylindrical basic shape with a skin 3 stretched over it. The resonance body 2 has openings 4 in which bells 5 are mounted in a manner known per se.

The skin 3 is fixed by means of a cross-sectionally round clamping hoop 6 of spring steel of for instance 4 mm of diameter. Correspondingly, this clamping hoop 6 can be elastically expanded in the radial direction. An annular groove 7 semi-circular in cross-section serves to fix the clamping hoop 6 on the resonance body 2. On the upper side, the outside diameter of the resonance body 2 exceeds the inside diameter of the clamping hoop 6 by 0.8 mm.

For the skin to be applied, the upper edge 8 of the resonance body 2, which has a sloping edge 9 externally, is provided with glue. Then the skin 3 is stretched over the upper side of the resonance body 2 and the clamping hoop 6 is forced on from above by means of a hydraulic press, whereby the skin is stretched without any additional steps being necessary. The clamping hoop 6 slips over the sloping edge 9 and moves into the annular groove 7 where it is fixed, there being no need for any additional anchoring, in particular screws or the like not being necessary.

While for instance the combination of a polyester film with wax paper laminated thereon has conventionally been used for the skin 3, the invention provides that the skin 3 consists of a plastic film 11 and a nonwoven layer 10, both having the same size and being parallel to each other without, however, being united by gluing.

What is claimed is:

1. A percussion instrument, for example in the form of a tambourine, of bongos, congas or the like, with a resonance body open in particular on top, a skin being stretched over the upper opening and comprising a plastic film which is fixed at a constant tension by means of a clamping hoop, the skin being stretched directly over the resonance body, and the resonance body having an annular groove in the vicinity of the upper opening, and the clamping hoop being elastically widened and forced over the upper side of the resonance body into the annular groove, thus stretching the skin, wherein at least one nonwoven fabric (10) is disposed in parallel to the at least one plastic film (11), the nonwoven (10) fabric also being stretched by the clamping hoop (6) and not being joined to the plastic film (11) by gluing.

2. A percussion instrument according to claim 1, wherein the nonwoven fabric is a flash-melt-spun material.

3. A percussion instrument according to claim 1, wherein the nonwoven fabric is a polyethylene fiber material.

4. A percussion instrument according to claim 1, wherein the plastic film is a polyester film.

* * * * *